US006274954B1

(12) United States Patent
Gander et al.

(10) Patent No.: US 6,274,954 B1
(45) Date of Patent: Aug. 14, 2001

(54) ELECTROMAGNETIC ACTUATOR FOR ACTUATING A GAS-EXCHANGING VALVE

(75) Inventors: Hans Gander, Bad Urach; Frank Kirschbaum, Stuttgart; Guenter Stoehr, Siegen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/529,219

(22) PCT Filed: Oct. 10, 1997

(86) PCT No.: PCT/EP98/05510

§ 371 Date: Apr. 10, 2000

§ 102(e) Date: Apr. 10, 2000

(87) PCT Pub. No.: WO99/19609

PCT Pub. Date: Apr. 22, 1999

(30) Foreign Application Priority Data

Oct. 10, 1997 (DE) ..... 197 44 714

(51) Int. Cl.[7] ..... H02K 33/02
(52) U.S. Cl. ..... 310/30; 310/17
(58) Field of Search ..... 310/12, 13, 14, 310/15, 17, 20, 23, 28, 30, 31, 34

(56) References Cited

U.S. PATENT DOCUMENTS 3,965,377 6/1976 Carbonneau ..... 310/12

FOREIGN PATENT DOCUMENTS 2458635 6/1976 (DE) .
3024109A1 1/1982 (DE) .
195 18 056A1 11/1996 (DE) .
02291412 12/1990 (JP) .

*Primary Examiner*—Nestor Ramirez
*Assistant Examiner*—Judson H. Jones
(74) *Attorney, Agent, or Firm*—Crowell & Moring, L.L.P.

(57) ABSTRACT

The invention is based on an electromagnetic actuator for activating a gas exchange valve. The latter has both an opening magnet and a closing magnet, between which an armature which is connected to a valve stem is arranged in a coaxially displaceable fashion. The armature is held in a position of equilibrium between the magnets by means of an upper and a lower prestressed valve spring when the magnets are in a currentless state. In order to be able to control the actuator better, a plunger coil is connected to a valve stem of the gas exchange valve and is arranged coaxially with respect to said valve stem. Said plunger coil dips into a radially magnetized air gap of an annular, axially magnetized permanent magnet.

12 Claims, 1 Drawing Sheet

ELECTROMAGNETIC ACTUATOR FOR ACTUATING A GAS-EXCHANGING VALVE

BACKGROUND AND SUMMARY OF THE INVENTION

This application claims the priority of German Patent No. 19744714.74, filed Oct. 10, 1997, the disclosure of which is expressly incorporated by reference herein.

The invention relates to an electromagnetic actuator for activating a gas exchange valve.

Controlling gas exchange valves in a variable fashion can significantly improve the efficiency and the emission characteristics of pollutants in internal combustion engines. Electromagnetic actuators are used in this respect to activate the gas exchange valves. As a rule, they have two switching magnets, specifically an opening magnet and a closing magnet, between whose pole faces an armature can move coaxially with respect to the longitudinal axis of the gas exchange valve. The armature acts on a valve stem of the gas exchange valve, directly or via an armature bolt. In the case of actuators according to the principle of the mass oscillator, a prestressed spring mechanism acts on the armature. Usually, two prestressed compression springs, specifically an upper and a lower valve spring, are used as the spring mechanism. The upper valve spring loads the gas exchange valve in the opening direction, and the lower valve spring loads it in the closing direction. In the case of currentless magnets, the armature is held by the valve springs in a position of equilibrium between the magnets, which normally correspond to the center position between the pole faces of the magnets.

If the actuator is activated at the start, either the closing magnet or the opening magnet is briefly over-excited in order to attract the armature out of the position of equilibrium, or an oscillation excitation routine is performed, in which the magnets are alternately actuated in order to cause the gas exchange valve and the armature to oscillate until the armature can be captured by a magnet. In the closed position of the gas exchange valve, the armature bears against and is held by the pole face of the excited closing magnet it. The closing magnet further prestresses further the valve spring which acts in the opening direction. In order to open the gas exchange valve, the closing magnet is switched off and the opening magnet is switched on. The valve spring, which acts in the opening direction, accelerates the armature beyond the position of equilibrium, with the result that the armature is attracted by the opening magnet. The armature is decelerated by the valve spring which acts in the closing direction and impacts against the pole face of the opening magnet where it is held firmly by the pole face. In order to close the gas exchange valve again, the opening magnet is switched off and the closing magnet is switched on. The closing procedure proceeds in a way corresponding to the opening procedure.

The German Patent DE 3024109 C2 discloses an electromagnetically activated gas exchange valve for internal combustion engines. An armature is held between an opening magnet and a closing magnet by at least two springs according to the principle of a spring mass oscillator. The armature which is connected to the valve stem of the gas exchange valve is attracted by closing magnets when the gas exchange valve closes because an opening spring is prestressed. If the control valve opens, the closing magnet is deenergized and the opening spring moves the gas exchange valve into the open position with the cooperation of the excited opening magnet.

In order to minimize the energy requirement and wear, and to achieve any desired opening profile of the gas exchange valve, it is a goal to provide a controlled operation of the actuator. Control with the known actuators is difficult because, during the flying phase, forces have to be exerted on the armature over a large, constantly changing air gap. This leads to high actuation currents of the magnets and strong non-linearities. At the same time, a position and velocity of the armature can be determined only with a high degree of expenditure.

The invention is based on the object of improving the controllability of an actuator. According to the invention, the known actuator principle is expanded by a plunger coil drive which is used as an actuator element and a velocity sensor during the flying phase. For this purpose, a plunger coil is connected to the valve stem of a gas exchange valve, is arranged coaxially with respect to said valve and, during the movement of the valve stem, is always located in a radially magnetized air gap of an annular, axially magnetized permanent magnet, i.e. a subregion of the plunger coil is located in the air gap at all times. The number of coil turns which is effective in the air gap given a homogeneous winding structure always remains the same, i.e. the distance by which the plunger coil dips into the air gap is irrelevant. The section of the plunger coil in the air gap which is effective in terms of the field is independent of the position of the valve stem. As a result, the system behaviour remains constant and does not change with the armature travel.

In order to be able to influence the velocity of the armature with the opening magnet and/or closing magnet during the flight, a wide, constantly changing air gap must be magnetized. This leads to a high current requirement with extremely non-linear conditions. Given a minimum constant air gap and a linear dependence of the force on the current, the supplementary plunger coil drive according to the invention can be used, during the flying phase, to exert force on the armature and thus control its flight. In this context, depending on the direction of the current and of the movement, it is possible to feed energy to the system, the armature being accelerated, or energy being drawn off, as a result of which the armature is braked. At the same time, the voltage which is induced in the plunger coil can be used, according to one refinement of the invention, to detect the velocity of the gas exchange valve and, if appropriate, determine the position from it. The plunger coil arrangement according to the invention is therefore used both as a linear actuator element and also to measure the velocity, and thus facilitates controlled operation of the actuator.

If the valve stem or its bearing faces are fabricated from a material with a high permeability, it is advantageous for the plunger coil to be located radially within the permanent magnet. On the other hand, if the permeability of the material is low, it is preferable that the plunger coil be located radially outside the permanent magnet. This variant has the advantage of being able to develop a relatively high force by virtue of the relatively large conductor length located in the magnetic field.

The plunger coil drive is expediently located on that side of the actuator which faces the valve plate, (i.e. on the opening-magnet side), but it can also be arranged on the opposite end face of the actuator if the valve stem is guided through the armature and the actuator. In addition, it is possible to arrange plunger coil drives on both sides of the actuator.

The voltage, which is induced in the plunger coil during the movement in the magnetic field of the permanent magnet, is expediently fed, as a measurement signal, to an electronic control device processes with a microprocessor. The control device the signals with further parameters and characteristic variables to form appropriate open-loop and closed-loop control variables.

Other objects, advantages and novel features of the present invention will become apparent from the following detailed description of the invention when considered in conjunction with the accompanying drawings.

BRIEF DESCRIPTION OF THE DRAWINGS

Further advantages emerge from the following description of the drawings. The exemplary embodiments of the invention are illustrated in the drawing. The description and the claims contain numerous features in combination. The person skilled in the art will also expediently consider the features individually and combine them in further appropriate ways. In said drawings:

DETAILED DESCRIPTION OF THE PREFERRED EMBODIMENT

Figure 1:
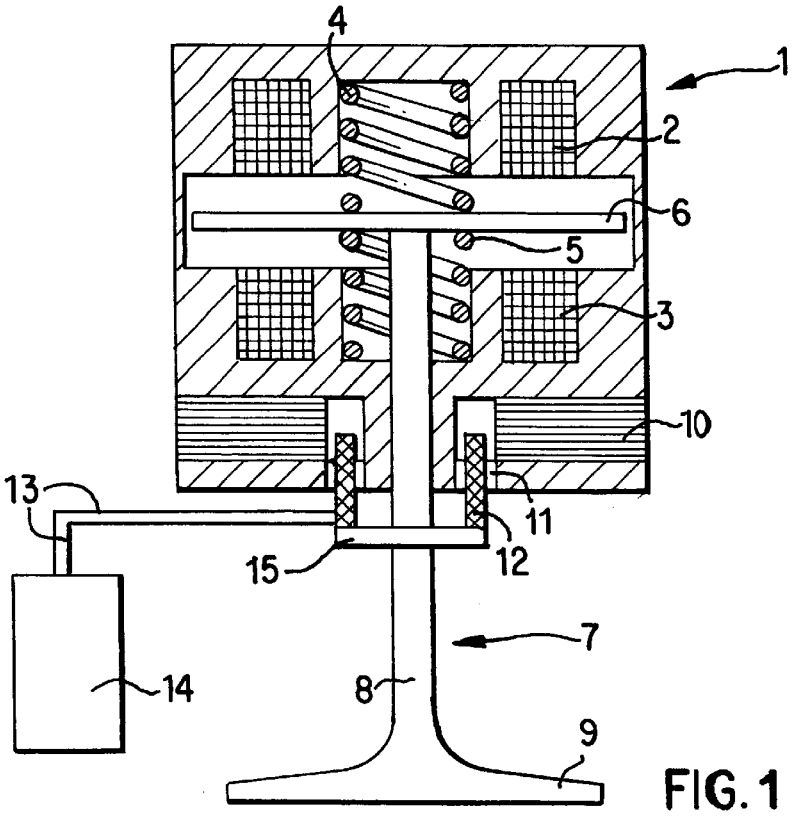
FIG. 1 shows a schematic cross section through an actuator according to the invention having a plunger coil lying on a small radius.
Figure 2:
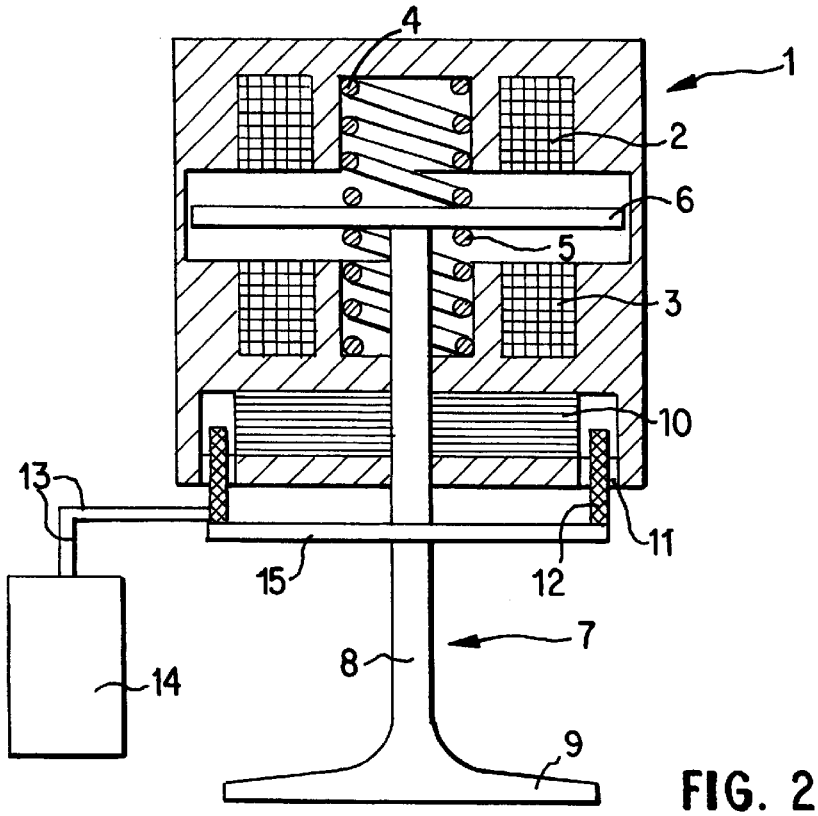
FIG. 2 shows a variant according to FIG. 1 with a plunger coil lying on a large radius.

An actuator 1 has an upper closing magnet 2 and a lower opening magnet 3 which act on an armature 6 in the excited state. The armature is connected to a valve stem 8 of a gas exchange valve 7 and is held in a position of equilibrium by an upper valve spring 4 and a lower valve spring 5 as long as the magnets 2 and 3 are currentless. If the actuator 1 is activated at the start, either the closing magnet 2 or the opening magnet 3 is briefly overexcited in order to attract the armature 6 out of the position of equilibrium, or an oscillation excitation routine is performed, in which the magnets 2 and 3 are alternately actuated in order to cause the gas exchange valve 7 and the armature 6 to oscillate until the armature 6 can be captured by a magnet 2 or 3. In the closed position of the gas exchange valve 7, the armature 6 bears against the excited closing magnet 2. The closing magnet 2 prestresses further the upper valve spring 4 which acts in the opening direction. If the closing magnet 2 is switched off and the opening magnet 3 is switched on, the armature oscillates to the opening magnet 3, and a valve plate 9 of the gas exchange valve 7 lifts off from a valve seat (not illustrated), with the result that the gas exchange valve 7 opens.

A plunger coil drive which comprises an annular, axially magnetized permanent magnet 10 and a plunger coil 12 is arranged on that side of the actuator 1 which faces the valve plate 9. Here, the permanent magnet 10 is integrated into the actuator 1, while the plunger coil 12 is attached to a collar 15 of the valve stem 8. The plunger coil 12 dips into an axially extending air gap 11 which is radially magnetized by the permanent magnet 10. By means of the plunger coil 12, energy can be supplied to or drawn off from the system, as a result of which the movement of the gas exchange valve 7 is accelerated or decelerated.

During the movement of the plunger coil 12 in the magnetic field of the permanent magnet 10, a voltage is induced in the plunger coil 12 which is applied between two control lines 13 which lead out of the plunger coil 12. The signal of the voltage is fed via the control lines 13 to an electronic control unit 14 with a microprocessor. These signals are processed in the control unit 14 with other parameters to form appropriate open-loop and closed-loop control variables and are fed as control variables to the actuator 1 and/or the plunger coil 12. A current does not flow in the plunger coil 12 until there is loading by passive or active electrical components in the control unit 14.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electromagnetic actuator for activating a gas exchange valve, said gas exchange valve having an opening magnet and a closing magnet with an armature connected to a valve stem arranged in a coaxially displaceable fashion and wherein an upper and a lower prestressed valve spring hold said armature in a position of equilibrium between said opening and said closing magnet when said opening magnet and said closing magnet are both in a currentless state, said actuator comprising:

a plunger coil connected to said valve stem wherein said plunger coil is arranged coaxially with respect to said valve stem; and an annular axially magnetized permanent magnet having a radially magnetized air gap wherein a portion of said plunger coil is positioned within said air gap.

2. The actuator according to claim 1, wherein said plunger coil is located radially within the permanent magnet.

3. The actuator according to claim 1, wherein the plunger coil is located radially outside the permanent magnet.

4. The actuator according to claim 1, wherein a voltage induced in the plunger coil is used to detect at least one of a position and a velocity of said valve stem.

5. The actuator according to claim 1, wherein a voltage induced in the said plunger coil is used as a signal for an electronic control device.

6. The actuator according to claim 1, wherein said permanent magnet is integrated into said actuator and adjoins the opening magnet towards the valve plate.

7. An electromagnetic activated gas exchange valve comprising:

an opening magnet;

a closing magnet;

an armature arranged in a coaxially displaceable fashion between said opening magnet and said closing magnet wherein said armature is connected to a valve stem;

an upper prestressed valve spring and a lower prestressed valve spring for holding said armature in a position of equilibrium between said opening magnet and said closing magnet when said opening magnet and said closing magnet are both in a currentless state;

a plunger coil connected to said valve stem and arranged coaxially with respect to said valve stem; and an annular, axially magnetized permanent magnet having a radially magnetized air gap wherein a part of said plunger coil is positioned within said radially magnetized air gap.

8. The gas exchange valve according to claim 7, wherein said plunger coil is located radially within the permanent magnet.

9. The exchange valve according to claim 7, wherein the plunger coil is located radially outside the permanent magnet.

10. The exchange valve according to claim 7, wherein a voltage induced in the plunger coil is used to detect at least one of a position and a velocity of said valve stem.

11. The exchange valve according to claim 7, wherein a voltage induced in the plunger coil is used as a signal for an electronic control device.

12. The exchange valve according to claim 7, wherein said permanent magnet is integrated with said gas exchange valve and adjoins the opening magnet toward a valve plate.

* * * * *